United States Patent [19]

Weise

[11] 4,067,386

[45] Jan. 10, 1978

[54] CASING COLLAR INDICATOR

[75] Inventor: Stanley Allan Weise, Dallas, Tex.

[73] Assignee: Dresser Industries, Inc., Dallas, Tex.

[21] Appl. No.: 708,259

[22] Filed: July 23, 1976

[51] Int. Cl.[2] ..... E21B 47/00

[52] U.S. Cl. ..... 166/64; 166/255; 166/241

[58] Field of Search ..... 166/64, 241, 173, 175, 166/250, 255

[56] References Cited

U.S. PATENT DOCUMENTS

| | | | |
|---|---|---|---|
| 1,898,074 | 2/1933 | Bailey | 166/241 |
| 2,656,890 | 10/1953 | Brandon | 166/241 |
| 2,944,608 | 7/1960 | Rush | 166/241 |
| 3,055,432 | 9/1962 | Park | 166/241 |
| 3,061,010 | 10/1962 | Conrad et al. | 166/64 |
| 3,312,285 | 4/1967 | Solum | 166/241 |
| 3,578,084 | 5/1971 | Bombardieri et al. | 166/241 X |
| 3,978,924 | 9/1976 | Roesner | 166/241 |

*Primary Examiner*—Stephen J. Novosad
*Attorney, Agent, or Firm*—Michael J. Caddell

[57] ABSTRACT

A tubing string device for giving an indication of the location of casing collars in a cased wellbore utilizes a tubular body having a resilient sleeve mounted thereon, and axial spring means abutting the resilient sleeve.

9 Claims, 1 Drawing Figure

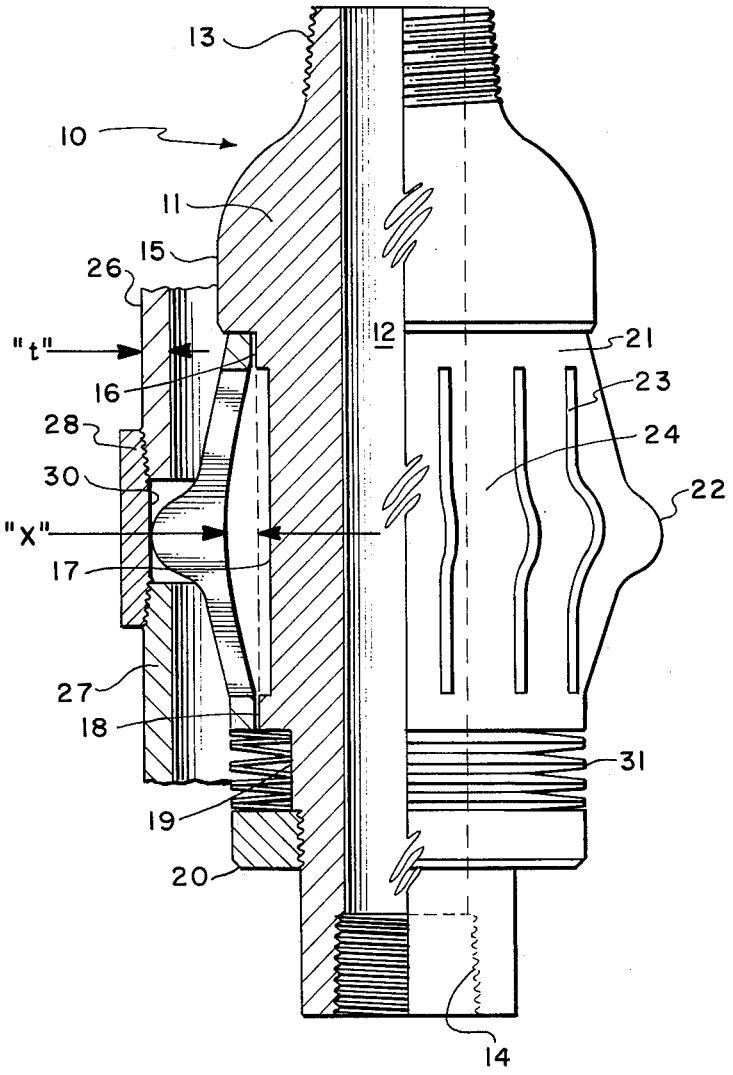
13
10
11
15
26
"t"
16
28
30
"X"
17
27
18
19
20
12
21
23
24
22
31
14

CASING COLLAR INDICATOR

BACKGROUND OF THE INVENTION

In the process of completing most oil wells, a string of conduit is placed into the open borehole and cemented in place by pumping a cement slurry down the annulus between the casing and the borehole wall.

The conduit or "casing" is run in the borehole in standard length sections joined together by threaded collars. The casing ends are threaded into the collars but the two ends are not in abutting relationship with each other leaving an axial annular space within each collar.

After the casing is cemented in the well, the casing may be perforated at the producing locations which have been located by sophisticated electronic, sonic, and radioactive logging methods. When lowering a perforating tool into the wellbore, it is desirable to have a quick, easy method to monitor how far down the borehole the tool has traveled so that it can be placed precisely adjacent the desired perforating location.

This can be accomplished roughtly by measuring the wireline or tubing carrying the tool into the well. To be more accurate, the operator needs to be able to correlate the depth with the well log. This he can do if he can know when the tool is at a specific casing collar near the formation to be perforated.

This knowledge can be ascertained by the use of a casing collar indicator. The prior art devices utilize electronic and magnetic sensing means to attempt to locate the collars. Other types utilize mechanical indicators which have fingers or blocks that must slide outward into engagement in the collar. These devices suffer reliability deficiencies because of their complexity and inability to distinguish collars from other types of discontinuities in the casing string.

The present invention provides a much less complex and more reliable apparatus to indicate when the tool has engaged a collar. Used in connjunction with a weight indicator on the tubing string, the present invention gives a precise indication of when the collar has been engaged.

The tool is also advantageous when lowering into the wellbore, a production or workover string containing packers, valves and other tools which need to be placed in close proximity to a producing formation.

BRIEF DESCRIPTION OF THE DRAWING

FIG. 1 is a partial cross-sectional view of the preferred embodiment.

DESCRIPTION OF THE PREFERRED EMBODIMENTS

FIG. 1 illustrates in partial cross-sectional view the casing collar indicator 10 having a main body 11 with an axial bore passage 12 passing centrally therethrough. Body 11 has an outer threaded portion 13 at its upper end and an inner threaded portion 14 at the lower end for threadably engaging a string of well tubing. Body member 11 also has an upper expanded shoulder area 15, a stepped shoulder area 16, and a recessed annular area 17.

A lower stepped portion 18 encircles body 11 at the lower end of recess 17 and a bottom recess 19 is located below shoulder 18. A threaded nut 20 is threaded on body 11 below recess 19. A slotted bowed sleeve 21 encircles body member 11 in contact with shoulders 16 and 18. Sleeve 21 is bowed outwardly and contains an annular outwardly projecting shoulder portion 22 having a curvilinear cross-sectional configuration.

A plurality of equi-spaced longitudinal slots 23 are formed through the wall of sleeve 21 and pass through annular shoulder 22. The provision of slots 23 results in the formation of a number of longitudinal arms 24 which are resiliently flexible in a radial direction. The amount of outward curvature of sleeve 21 is measured by the distance $x$ illustrated in FIG. 1, which distance is the difference between the diameter of shoulders 16 and 18 and the greatest inner diameter of sleeve 21.

The casing collar indicator 10 is illustrated in a string of casing shown in break-away illustration at 26 and 27. A cylindrical casing collar 28 threadedly connects upper casing section 26 with lower casing section 27. Since the adjacent ends of the casing sections are not threaded into collar 28 sufficiently to abut each other, an annular space 30 is formed therebetween.

The annular space 30 has a radial dimension equivalent to the dimension $t$, which is the approximate thickness of the casing. In one embodiment, the amount of maximum outward curvature of sleeve 21 is relatively equivalent to the thickness $t$ of the casing. Thus, when the apparatus 10 engages in a collar annulus 30, the projecting shoulder 22 will just contact the inner wall of collar 28 and the resilient force will be relaxed in sleeve 21.

In addition to the outward resilient force on shoulder 22 from the initial outward bowed configuration of sleeve 21, other resilient biasing means can also be used to complement the spring force of the bowedsleeve. One form of such additional springing force which may be advantageously utilized in this apparatus comprises a series of belleville spring washers 31 abutting the lower end of spring 21 and held in encircling relationship on member 11 by threaded nut 20.

In place of belleville spring washers, it would be possible to utilize other spring means, such as a coil spring, but the belleville washers are advantageous because they offer a high spring load in a short compression distance. If the dimension $x$ is made substantially equal to dimension $t$, it can be seen that normally the action of spring means 31 is neutral in the radial direction and is acting solely in an axial direction thereby contributing nothing to the outward force of the arms 24.

The belleville spring load is thus not additive to the resilient spring load of arms 24, pressing projections 22 against the casing wall, as long as the apparatus 11 is not located in a collar area. Once the projection 22 passes from the casing section 26 into the collar annulus 30, the force of springs 31 is added to the outward force of spring fingers 24, thereby aiding in maintaining projections 22 engaged in the annulus 30.

Because of this relatively high force pushing the shoulders 22 outward against the collars 28, a strong indication is given at the weight indicator on the surface each time a collar is engaged by the tool 10. It can be seen that as projection 22 movesdownward in annular space 30 and contacts the upper end of casing section 27, a substantial portion of the weight of the tool string will be removed from the upper portion of the string and supported by the abutment of shoulder 22 on casing 27. This will give a sharp indication on the weight indicator at the surface that a weight reductionn in the string has occurred and the operator will realise that a collar has been engaged.

As weight is placed down on the string, the projection of 22 will be cammed radially inward until projection 22 slides inside casing 27. At this time, spring members 31 will be directing a spring force parallel to the central axis of body 11 and will add no further drag to projections 22 while traversing casing sections 27. Thus, the force arising from spring means 31 comes into play only while the tool passes through a joined section at the collar 28.

While this additive spring force further enhances the operation of the tool, it can be seen that the casing collar indicator will operate successfully without this secondary biasing spring means. In operation, the tool 10 is threadably inner connected into the work string at threaded ends 13 and 14 as the string is being lowered into the hole. Preferably the casing collar indicator 10 will be located in relatively close proximity to the perforating or treating tool which is to be placed in the desired location.

As the tool string is lowered into the borehole, the projections 22 will be forced radially inward while traversing each section of the casing. As the projections 22 pass out the bottom of each casing section, they will be biased radially outward into contact with the casing collars and upon passing to the length of the collar, annulus will abut the upper end of the next adjacent casing section. At this moment, a sharp weight reduction will register on the tool string weight indicator at the surface and the operator will know that a collar has been located by the tool 10.

When the tool has passed through the predetermined number of casing sections and has located the particular collar near the formation to be perforated or treated, the tool operator can then move the tool string the required distance from the collar to obtain a very accurate location on the desired underground formation.

The particular curvilinear surface for projections 22 may be selected to provide the desired weight indication with the given spring force arising from the elastic deflection of arms 24 from their initial outward bowed, relaxed position, and the spring members 31. In this embodiment, a parabolic curve is shown on member 22 but other type surfaces could be utilized, such as circular and elliptical. It would also be possible to provide angular shoulders on projections 22 although the curvilinear surfaces provide less wear and shock for sleeve member 21.

In addition, modifications of the ratio between the dimensions $x$ and $t$ can be made to alter the amount of drag force on the tool in the casing. For instance, if $x$ is made greater than $t$, an increased drag force will be encountered by the tool while passing inside the casing. Conversely, making $x$ smaller than $t$ will result in a reduction of drag in the casing below that normally occurring in the neutral position where $x$ equals $t$.

Although specific preferred embodiments of the present inventionhave been described in the detailed description above, the description is not intended to limit the invention to the particular forms or embodiments disclosed herein since they are to be recognized as illustrative rather than restrictive and it would be obvious to those skilled in the art that the invention is not so limited. For example, where belleville spring washers are utilized, it would be possible to use various other spring means such as coil springs. Also whereas parabolic curved surfaces are utilized on projections 22, it is clear that other configurations of the surfaces could be utilized also. Thus, the invention is declared to cover all changes and modifications of the specific example of the invention herein disclosed for purposes of illustration which do not constitute departures from the spirit and scope of the invention.

The embodiment of the invention in which an exclusive property or privilege is claimed are defined as follows:

1. A casing collar engaging tool comprising:

tubular cylindrical housing means having connecting means at each end for interconnection in a conduit string;

sleeve means encircling said housing means and having a plurality of resilient, outwardly biased integral arms;

shoulder means on said longitudinal arms projecting radially outward and adpated to snugly engage in a casing collar; and, means for holding said sleeve means longitudinally on said housing means.

2. The casing collar indicator of claim 1 furthercomprising axial biasing means between said holding means and said sleeve means and arranged to provide an axial biasing force on said sleeve means.

3. The casing collar indicator of claim 2 wherein said axial biasing means comprises resilient spring means encircling said housing means in abutment with said sleeve means and said holding means.

4. The casing collar indicator of claim 1 wherein said holding means comprises an annular outward shoulder formed on said housing means and a disconnectable annular outward shoulder connected to said housing means.

5. Apparatus for resiliently engaging annular openings in the inner wall of a string of tubular conduit, said apparatus comprising:

a tubular body having an axial bore passage therethrough and means for connecting said body into a tool string;

upper and lower outwardly extending annular shoulders on said tubular body forming a spaced annular opening therebetween; and, a resilient shouldered metallic sleeve secured in said annular opening between said shoulders and further comprising:

a generally circular outwardly curved sleeve member;

a plurality of longitudinal axial slots formed through the wall of said sleeve member and arranged to form a plurality of longitudinal, outwardly curved, resilient arms; and, shoulder means formed on said arms adapted to snugly engage a casing collar, and projecting radially outward therefrom.

6. The apparatus of claim 5 wherein said body is formed of metal and said sleeve is formed of a relatively elastic metal.

7. The apparatus of claim 5 further comprising axial spring means on said body between said sleeve and one of said annular shoulders and arranged to apply resilient longitudinal axial biasing force to said sleeve.

8. The apparatus of claim 7 wherein said spring means comprises one or more circular belleville springs.

9. The apparatus of claim 5 wherein said shoulder means comprises a radial outward projecting shoulder on each of said arms, with each said shoulder having a curvilinear surface.

* * * * *